US008052585B2

(12) United States Patent
Donaldson

(10) Patent No.: US 8,052,585 B2
(45) Date of Patent: Nov. 8, 2011

(54) REHABILITATION APPARATUS

(76) Inventor: Stuart Donaldson, Calgary (CA)

( * ) Notice: Subject to any disclaimer, the term of this patent is extended or adjusted under 35 U.S.C. 154(b) by 24 days.

(21) Appl. No.: 12/605,975

(22) Filed: Oct. 26, 2009

(65) Prior Publication Data

US 2010/0304933 A1 Dec. 2, 2010

Related U.S. Application Data

(60) Provisional application No. 61/197,075, filed on Oct. 24, 2008.

(51) Int. Cl.
*A63B 21/04* (2006.01)
*A63B 21/00* (2006.01)

(52) U.S. Cl. ..... 482/130; 482/129; 482/137

(58) Field of Classification Search ..... 482/10, 482/51, 92, 121–130, 133–137, 905
See application file for complete search history.

(56) References Cited

U.S. PATENT DOCUMENTS

| | | | | | |
|---|---|---|---|---|---|
| 948,140 | A | * | 2/1910 | Johnson | 73/379.08 |
| 3,953,026 | A | * | 4/1976 | Stokely | 482/123 |
| 4,583,731 | A | | 4/1986 | Crivello et al. | |
| D288,459 | S | | 2/1987 | Lee | |
| 4,666,149 | A | * | 5/1987 | Olschansky et al. | 482/130 |
| 5,070,863 | A | | 12/1991 | McArthur et al. | |
| 5,094,249 | A | | 3/1992 | Marras et al. | |
| 5,256,126 | A | | 10/1993 | Grotstein | |
| 5,378,611 | A | * | 1/1995 | Yoshioka et al. | 435/58 |
| 5,380,269 | A | | 1/1995 | Urso | |
| D380,024 | S | | 6/1997 | Novak et al. | |
| 6,004,246 | A | | 12/1999 | Sencil | |
| 6,045,491 | A | * | 4/2000 | McNergney et al. | 482/121 |
| 6,228,000 | B1 | | 5/2001 | Jones | |
| 6,354,982 | B1 | | 3/2002 | Sencil | |
| 6,746,384 | B2 | | 6/2004 | Cole et al. | |
| 7,137,933 | B2 | | 11/2006 | Shifferaw | |
| 7,563,213 | B2 | * | 7/2009 | Grant | 482/129 |

* cited by examiner

*Primary Examiner* — Stephen Crow
*Assistant Examiner* — Oren Ginsberg
(74) *Attorney, Agent, or Firm* — Montgomery Patent & Design; Robert C. Montgomery; Joseph T. Yaksich

(57) ABSTRACT

An exercise machine designed to enhance flexibility and allow for controlled stretching of torso muscles is herein disclosed. The machine comprises a padded cushion upon which a user is situated in a seated position. The machine also comprises a padded bolster which moves in a circular arc which the user pushes against with their back, chest, or side, depending on the seated position. The bolster supports and guides the user through a full arcuate motion from a vertical position downwardly toward the floor. The machine comprises a stationary second pad which supports a user's pelvis or waist area during the stretching therapy. The positions of both the bolster and stationary pad are adjustable in order to accommodate the user's size. The exercise machine utilizes a series of counterbalancing springs housed within a main enclosure to enable the user to easily return to a sitting position.

13 Claims, 10 Drawing Sheets

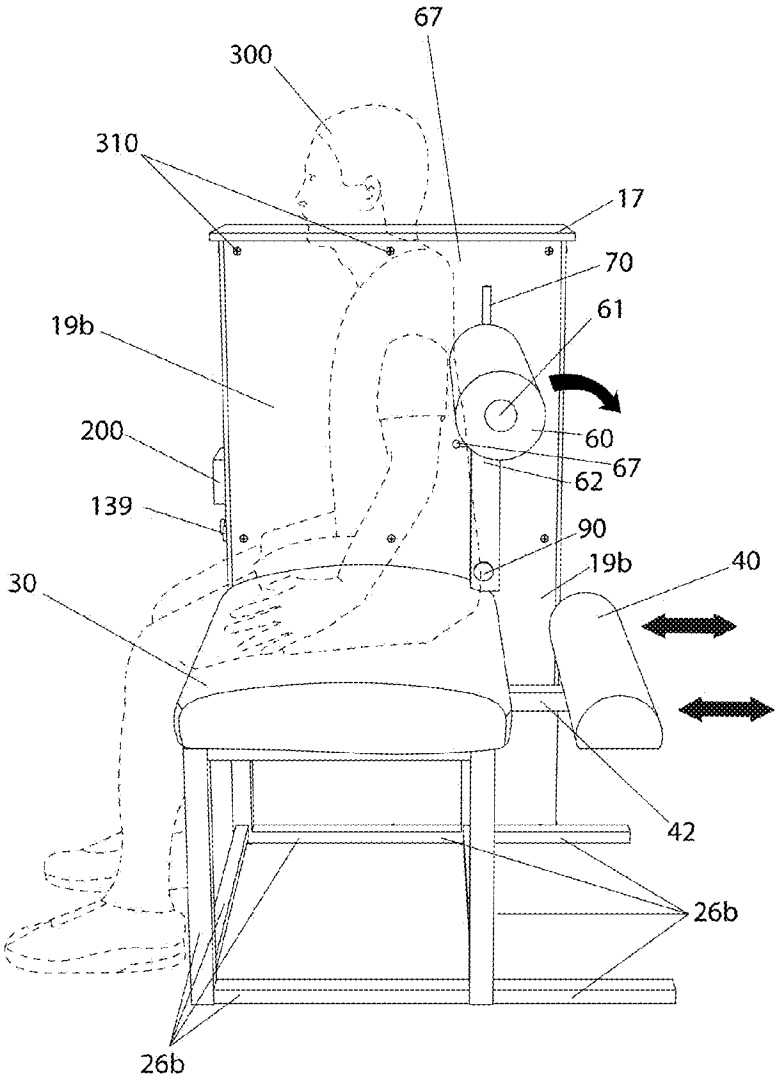
Fig. 4a
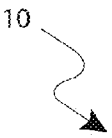

REHABILITATION APPARATUS

RELATED APPLICATIONS

The present invention was first described in and claims the benefit of U.S. Provisional Application No. 61/197,075, filed Oct. 24, 2008, the entire disclosures of which are incorporated herein by reference.

FIELD OF THE INVENTION

The present invention relates generally to exercise machines, and in particular, to a personal exercise machine designed for the stretching and rehabilitation of muscles, particularly back muscles.

BACKGROUND OF THE INVENTION

Back pain and injury is a widespread ailment. Many such injuries can linger for extended periods and can cause recurring discomfort and pain. These injuries and pain can stem from many different sources, including repeated lifting, bending, long periods spent in fixed positions, and the like.

In many cases, proper stretching of the back is considered to be an integral part of the recovery and rehabilitation process. However, personal back stretching routines such as twisting and bending is inadequate to fully stretch the back muscles. A much wider range of motion in many more directions is required in order to most completely and efficiently heal back ailments and restore comfort to the inflicted.

Various attempts have been made to provide a device which aids in the stretching and recuperation of back muscles. Examples of these attempts can be seen by reference to several U.S. patents. U.S. Pat. No. 5,256,126, issued in the name of Grotstein, describes an abdominal and back exercising apparatus. The Grotstein apparatus provides a resilient member to allow a user to undertake resistive sit-ups or resistive back exercises.

U.S. Pat. No. 6,746,384, issued in the name of Cole et al., describes an apparatus for exercising the lumbar region of the back. The Cole apparatus is designed for a user to exercise their back by bending and subsequently elevating their back muscles while simultaneously holding a set of handheld weights.

Additionally, ornamental designs for abdominal and back muscle stretching apparatuses exist, particularly U.S. Pat. Nos. D 288,459 and D 380,024. However, none of these designs are similar to the present invention.

While these devices fulfill their respective, particular objectives, each of these references suffer from one (1) or more of the aforementioned disadvantages. Many such devices do not allow sufficient customizability for users of different sizes and preferences. Also, many such devices are limited to the number of back stretches that can be performed. Furthermore, many such devices do not provide precise data feedback to a user.

Accordingly, there exists a need for a personal stretching and rehabilitation apparatus without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a stretching and rehabilitation apparatus focused on back muscles, which provides a user with customizability, versatility, and informational feedback. Thus, the object of the present invention is to solve the aforementioned disadvantages and provide for this need.

To achieve the above objectives, it is an object of the present invention to comprise an enclosure, a seat cushion, a support pad, a bolster, a bolster arm inner and outer post, and a data module.

Another object of the present invention is to comprise the enclosure of a rugged metal cabinet structure, which further comprises an internal welded frame, a removably attached top panel, and four (4) side exterior panels. The enclosure provides both a protective and aesthetic housing for internal equipment and components of the apparatus.

Yet still another object of the present invention is to comprise the frame of a weldment of rectangular structural tubing enclosure frame members. These members define the rectangular-shaped enclosure, provide support and attachment of the seat cushion, and provide an extended stabilizing platform along a floor surface.

Yet still another object of the present invention is to comprise the seat cushion of a padded rectangular form having a vinyl or leather covering over a foam rubber padded core. The seat cushion extends at a normal sitting height to provide padded seating to a user.

Yet still another object of the present invention is to comprise the support pad of a padded half-cylinder shaped member which provides stationary support to a user's lower back or other body portions during therapeutic exercises and movements.

Yet still another object of the present invention is for the enclosure to provide a rotary attachment means to a bolster arm outer post and bolster member. The bolster member provides resisting motion and easy return of the user's back area while performing exercises.

Yet still another object of the present invention is to comprise the data module of a commercially available microprocessor-based computing and display device with common and expected features. These features may include push buttons, digital displays, software functions, personal regimen data, personal therapy logging, music playing, and the like.

Yet still another object of the present invention is to comprise internal equipment to provide selectable torque to a pivot shaft to provide variable resistance to the bolster. The apparatus further comprises a shaft bracket, a main cable, a main pulley assembly, a load plate, fixed resistance springs, adjustable resistance springs, a spring support assembly, brake slides, and brake locking assemblies.

Yet still another object of the present invention is for the pivot shaft to extend internally between two (2) opposing side exterior panels, fixed on one (1) end to the bolster arm outer post and on the opposite end to a pair of anchoring shaft brackets. The pivot shaft provides rigid non-rotating attachment to a resistance disc at an intermediate position.

Yet still another object of the present invention is to comprise the resistance disc of a metal plate in the form of a quarter-circle and a cable slot which provides a means to nest and accumulate the main cable. The resistance disc provides an offset attaching and torque multiplying means to the main cable using a common threaded fastener.

Yet still another object of the present invention is to comprise the main cable of a length of common stainless steel wire or equivalent flexible conduit which is routed down from the resistance disc, through a main cable pulley portion of the main pulley assembly, and subsequently upward to be affixed to a bottom surface portion of the load plate.

Yet still another object of the present invention is for the load plate to provide an applied tensile force to the main cable via a plurality of tension springs affixed to a top surface of the load plate. Any number of desired fixed resistance and variable resistance springs may be used so as to provide a desired return force to the bolster.

Yet still another object of the present invention is to affix the main cable and tension springs to the load plate using a main cable eyelet and a corresponding number of spring eyelets, respectively.

Yet still another object of the present invention is to support and suspend the springs from a top portion of the frame via a spring support assembly. The spring support assembly further comprises a spring support bracket, a pair of fixed spring shafts, and an adjustable spring shaft. Each fixed resistance spring is statically anchored to a fixed spring shaft and each adjustable resistance spring is dynamically attached to the adjustable spring shaft via rotating spring pulleys.

Yet still another object of the present invention is to comprise the brake slides of a means to enable activation of a spring and spring load to be applied to the load plate by mechanically linking a desired number of adjustable resistance springs. A brake locking assembly provides a pinning means to anchor the brake slide.

Yet still another object of the present invention is to comprise the bolster arm outer post of a bolster locking mechanism, an actuating bolster locking mechanism knob, and an internal spring-loaded locking pin. The locking mechanism establishes a corresponding relative position between the bolster arm outer and inner posts.

Yet still another object of the present invention is to provide adjustment of the bolster height by retracting the locking pin with the bolster locking mechanism knob, vertically adjusting the bolster arm inner post, and inserting the locking pin into one (1) of a plurality of equally spaced bolster locking mechanism apertures arranged linearly along the inner post.

Yet still another object of the present invention is to further comprise the bolster arm inner post of a cylindrical hand grip which extends from an upper end of the post. The hand grip allows an assisting person or therapist to help the user obtain an upright seated position.

Yet still another object of the present invention is to comprise a plurality of brake slides, a plurality of brake slide brackets, and a plurality of brake locking assemblies. Each brake slide provides a means to actuate extension of an adjustable resistance spring, thereby allowing the user to select a variable force to be applied to the bolster.

Yet still another object of the present invention is to comprise a support pad arm, a pair of support arm brackets, and a support arm adjustment knob. These provide a means by which the support pad is attached to the seat cushion and may be adjusted or detached by a user to accommodate the needs of particular exercise or therapy requirements.

Yet still another object of the present invention is to provide a method of utilizing the device that provides a unique means of stretching and exercising in a manner which is safe, quick and customizable, and which provides particular benefit for those undertaking rehabilitation of back muscles or the like.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

FIG. 4*a* is a perspective view of a bolster 60 depicting a park position thereof, according to a preferred embodiment of the present invention;

DESCRIPTIVE KEY

Figure 1:
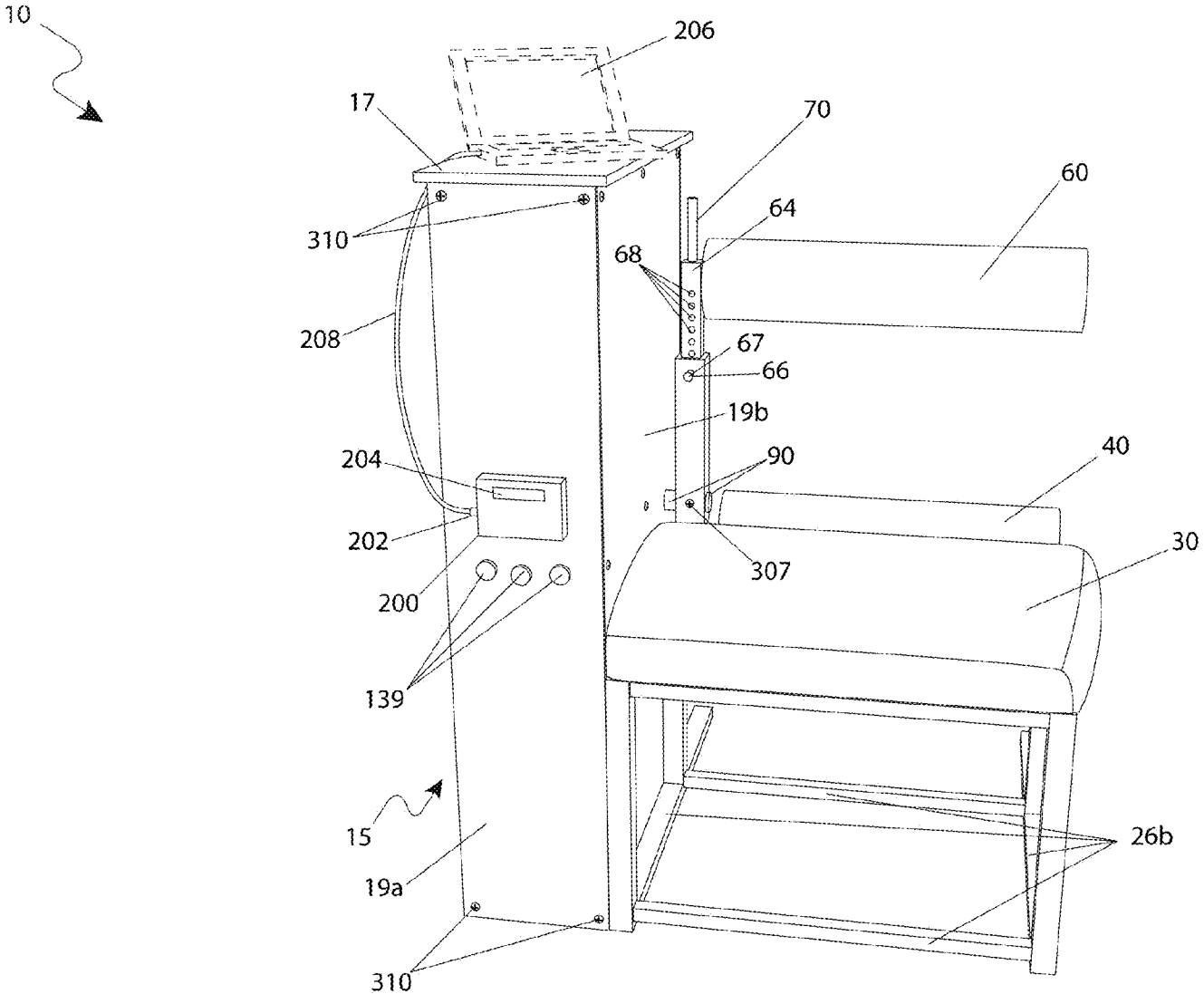
FIG. 1 is a front perspective view of a rehabilitation apparatus 10, according to a preferred embodiment of the present invention.

10 rehabilitation apparatus
15 enclosure
17 top exterior panel
19*a* first side exterior panel
19*b* second side exterior panel
19*c* third side exterior panel
19*d* fourth side exterior panel
24 frame
26*a* enclosure frame member
26*b* seat frame member
30 seat cushion
40 support pad
42 support pad arm
44 support pad arm bracket
46 support arm adjustment knob
60 bolster
61 bolster rod
62 bolster arm outer post
64 bolster arm inner post
66 bolster locking mechanism
67 bolster locking mechanism knob
68 bolster locking mechanism aperture
69 locking pin
70 grip
90 pivot shaft
92 shaft bracket
94 resistance disc
96 main cable
98 cable slot

112 fixed resistance spring
130 adjustable resistance spring
132 brake slide
133 brake slide aperture
134 brake slide bracket
135 return spring
136 brake locking assembly
138 brake toggle pin
139 brake toggle knob
140 spring support assembly
141 spring support bracket
142 spring pulley
143 fixed spring shaft
144 adjustable spring shaft
145 spring cable
160 load plate
162 main cable eyelet
163 spring eyelet
164 cushion spring
180 main pulley assembly
182 main cable pulley
184 main cable pulley bracket
200 data module
202 connector
204 display
206 computer
208 interface cable
300 user
305 nut fastener
307 setscrew
310 common threaded fastener

DETAILED DESCRIPTION OF THE PREFERRED EMBODIMENT

The best mode for carrying out the invention is presented in terms of its preferred embodiment, herein depicted within FIGS. 1 through 7*b*. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a rehabilitation apparatus (herein described as the "apparatus") 10, which provides an exercise and therapy machine designed to enhance flexibility and allow for controlled stretching of muscles, particularly muscles of a back. The apparatus 10 comprises a padded seat cushion 30 and a padded cylindrical bolster 60 which moves in a circular resistive arc. A user 300 pushes against the movable bolster 60 with back, chest, or side portions of their body, depending on a particular seated position. The bolster 60 supports and guides the user 300 through a full arcuate motion from between an upwardly vertical position and a position below a horizontal plane. The movable bolster 60 provides an adjustable return force thereto the user 300, thereby enabling an easy return thereto a sitting position via a plurality of tension springs 112, 130 being housed therewithin a main enclosure 15.

Referring now to FIG. 1, a front perspective view of the apparatus 10, according to the preferred embodiment of the present invention, is disclosed. The apparatus 10 comprises an enclosure 15, an inner frame 24, a seat cushion 30, a support pad 40, a bolster 60, a bolster arm outer post 62, a bolster arm inner post 64, and a data module 200. The enclosure 15 provides both a protective and an aesthetic housing thereto particular internal equipment and components necessary thereto operation of the apparatus 10 (see FIGS. 2 and 3). The enclosure 15 comprises a rugged metal cabinet structure approximately three (3) feet high, two (2) feet wide, and eighteen (18) inches deep. The enclosure 15 further comprises an internal welded frame 24, a removably attached top panel 17, and four (4) side exterior panels 19*a*, 19*b*, 19*c*, 19*d*. The top exterior panel 17 provides a convenient resting place for items such as, but not limited to: personal items, a computer 206, or the like. The frame 24 further comprises a weldment made up of rectangular structural tubing enclosure frame members 26*a* defining the rectangular-shaped enclosure 15 having an additional outwardly extending portion along one (1) side of said enclosure 15 forming a box-shaped portion providing support and attachment thereof a top-mounted seat cushion 30 as well as an extended stabilizing platform along a floor surface. The seat cushion 30 extends thereat a normal sitting height and provides padded seating thereto a user 300 while performing expected rehabilitation movements using the apparatus 10. The seat cushion 30 comprises a padded rectangular form having a vinyl or leather covering over a foam rubber padded core in an expected manner.

Figure 6:
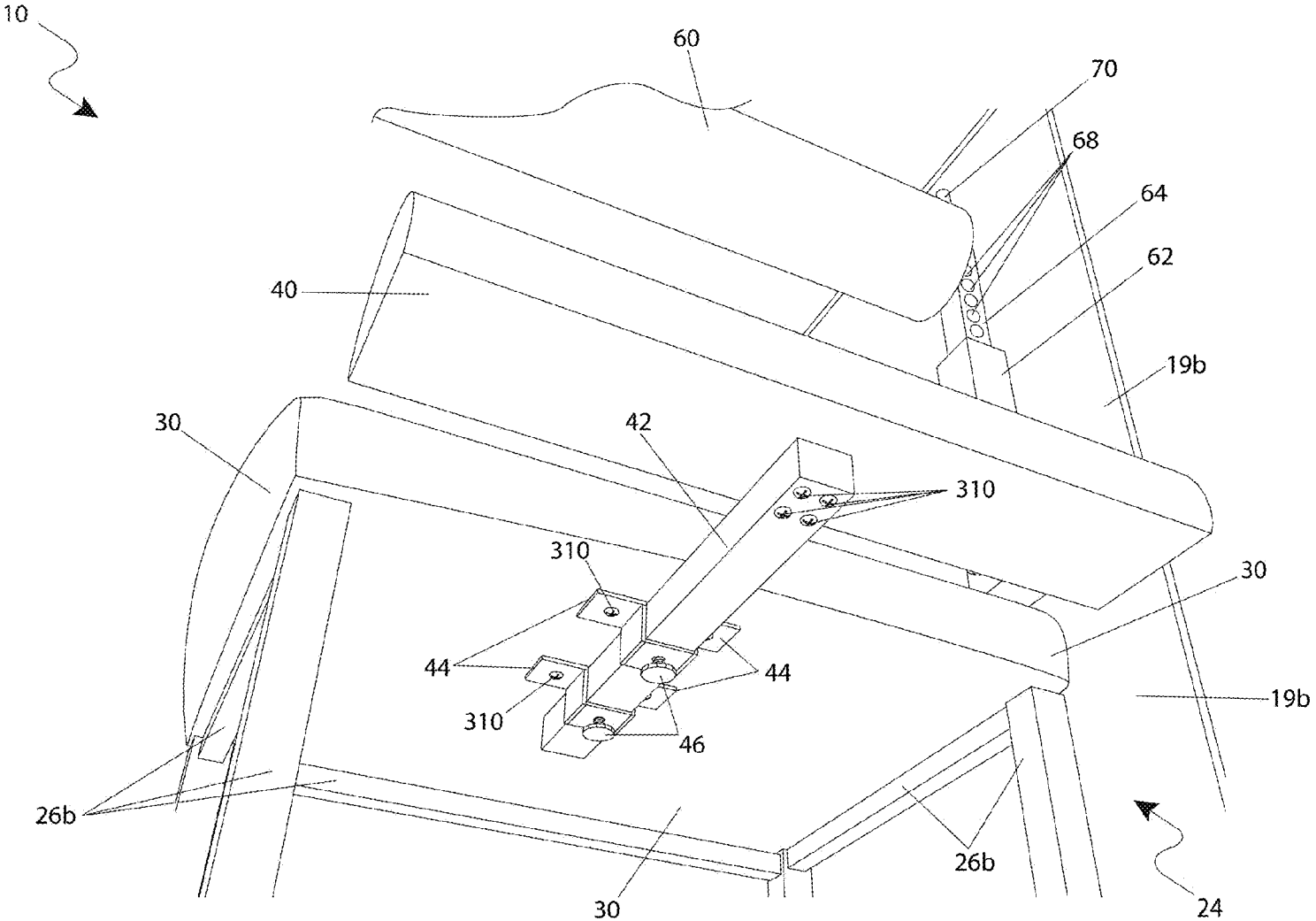
FIG. 6 is an upward looking view of a support pad arm portion 42 of the rehabilitation apparatus 10, according to a preferred embodiment of the present invention.

The seat cushion 30 and supporting seat frame members 26*b* provide an attachment means thereto an adjustable support pad 40 which adjustably extends horizontally outwardly therefrom a bottom surface of the seat cushion 30 via a support pad arm 42 (see FIG. 6). The support pad 40 comprises a padded half-cylinder-shaped cantilevered member providing extended stationary support thereto a user's 300 lower back, pelvis, or other body portions during various therapeutic exercises and movements. The enclosure 15 also provides a rotary attachment means thereto a bolster arm outer post 62 and attached bolster member 60 which extends laterally across a user's 300 chest or back area, thereby providing resisting motion thereof as well as easy return of the user 300 thereto a seated upright position while performing said therapeutic exercises.

The enclosure 15 also provides an attachment means thereto a data module 200 affixed thereto a first side exterior panel 19*a* using common fasteners 310 being adjacent thereto the seat cushion portion 30, thereby providing convenient access thereto a user 300. The data module 200 comprises a commercially available microprocessor-based computing and display device further comprising expected and common features such as, but not limited to: a compact rectangular plastic housing, a plurality of interface connectors 202, a plurality of operational push buttons, a computer interface cable 208, and a digital display 204. The data module 200 is envisioned to provide interface, display, and/or storage of a variety of electronic and software based functions such as, but not limited to: personal therapy regimen data, personal therapy logging, data and software uploading/downloading therefrom a portable computer 206, audio/music playing, heart rate/cadence monitoring, and the like.

Figure 2:
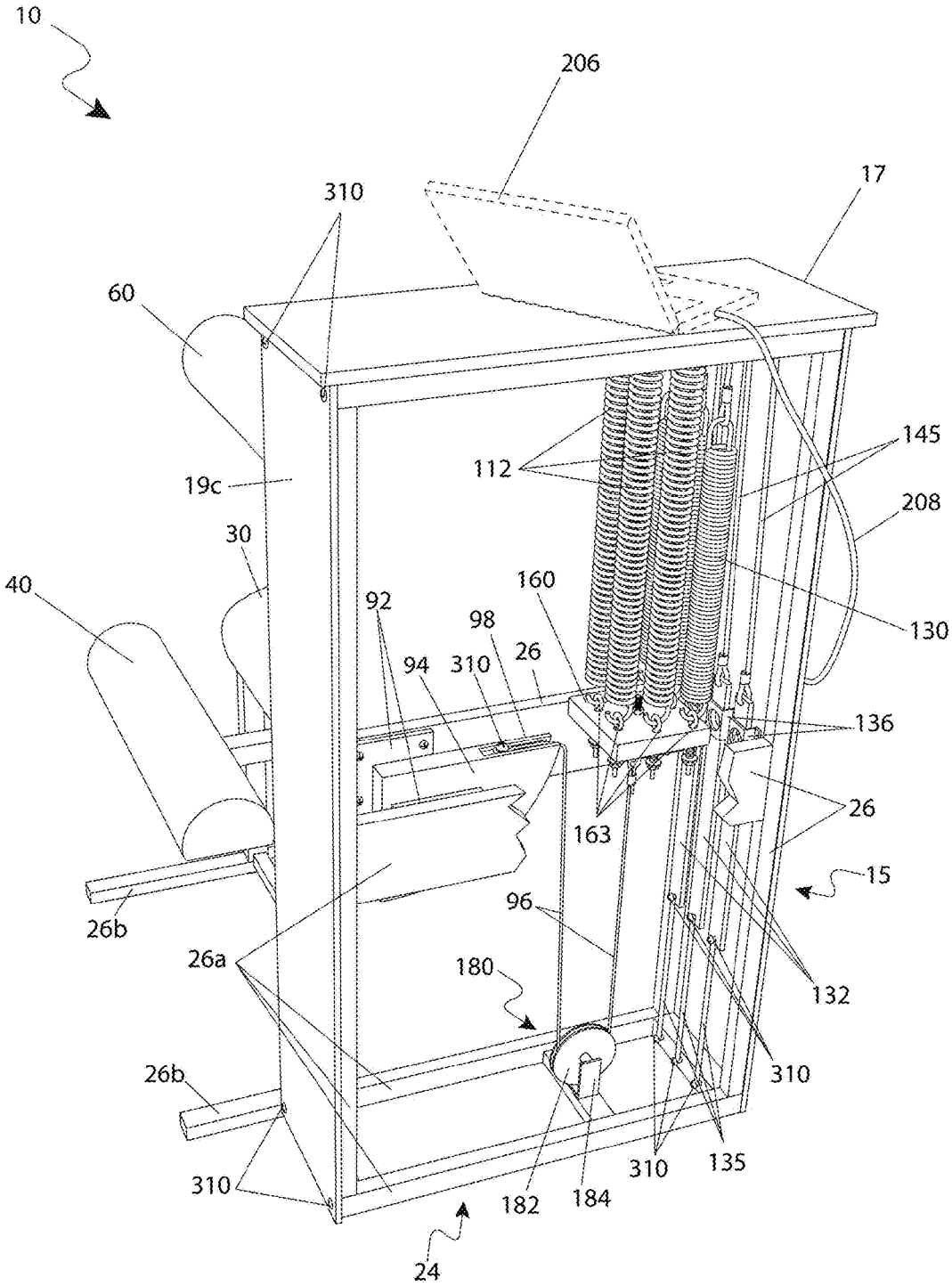
FIG. 2 is a rear perspective view of the rehabilitation apparatus 10 illustrating an interior view, according to a preferred embodiment of the present invention.
Figure 3:
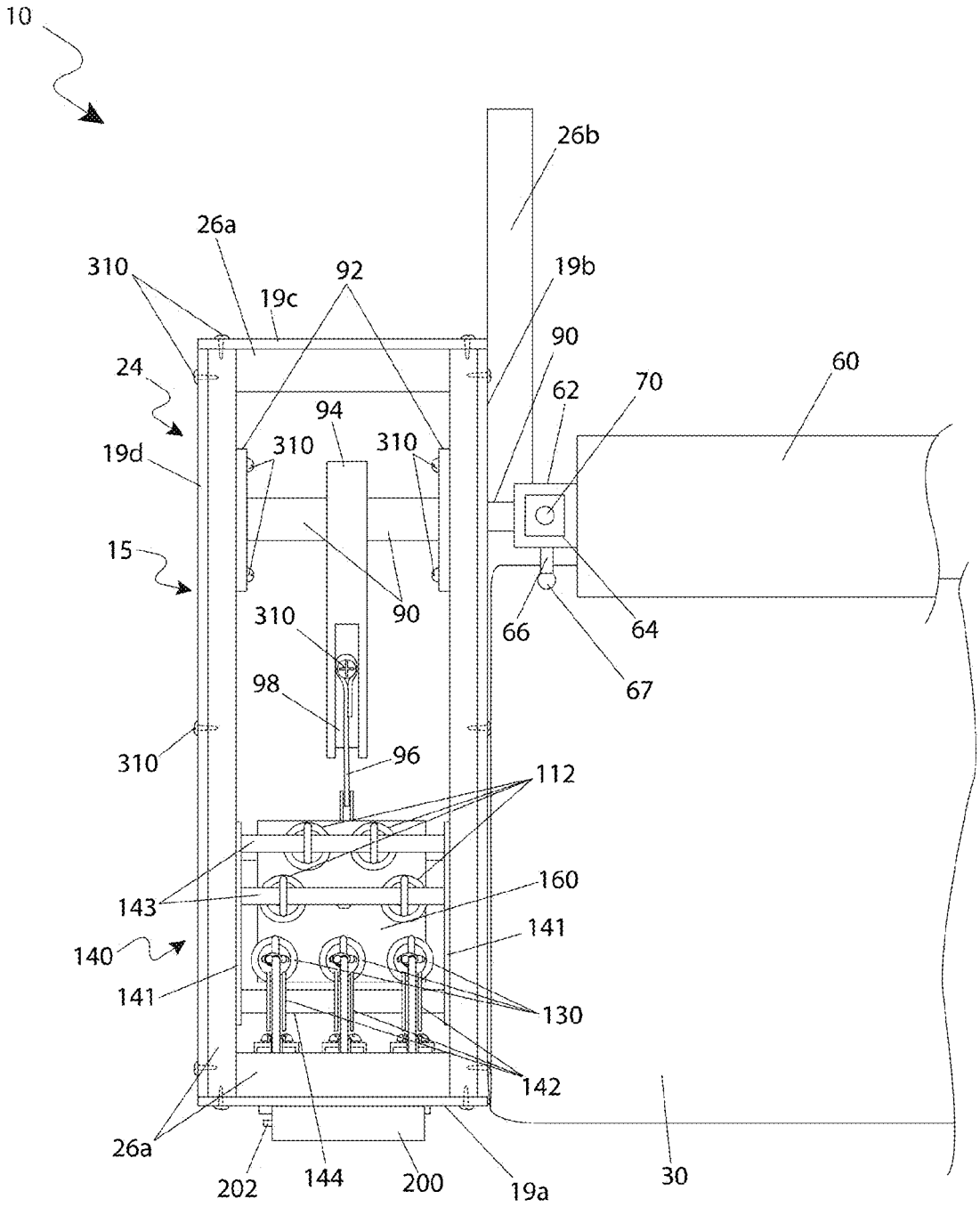
FIG. 3 is a top interior view of the rehabilitation apparatus 10, according to a preferred embodiment of the present invention.

Referring now to FIGS. 2 and 3, rear and top views of the apparatus 10 illustrating interior views, according to the preferred embodiment of the present invention, are disclosed. The apparatus 10 is illustrated here having a top exterior panel 17 and a fourth side exterior panel 19*d* removed for illustration sake. The apparatus 10 comprises internal equipment which provides a selectable torque thereto a pivot shaft 90 which provides a variable resisting motioning thereto the rotating bolster 60 as well as aiding a user 300 or patient while returning thereto an upright and seated position, thereby reducing strain to various muscle and skeletal groups while performing therapeutic motions. The apparatus 10 comprises a shaft bracket 92, a main cable 96, a main pulley assembly 180, a load plate 160, four (4) fixed resistance springs 112, three (3) adjustable resistance springs 130, a spring support assembly 140, three (3) brake slides 132, and three (3) brake locking assemblies 136.

The pivot shaft 90 extends internally between two (2) opposing side exterior panels 19 therein a horizontal direction being affixed thereto a bolster arm outer post 62 thereat a distal end portion and thereto a pair of anchoring shaft brackets 92 affixed thereto opposing frame members 26 thereat a proximal end. The pivot shaft 90 provides rigid non-rotating attachment thereto a resistance disc 94 thereat an intermediate position. Said resistance disc 94 comprises a metal plate approximately one (1) inch thick taking a form of a quarter-circle and extending perpendicularly outwardly therefrom said pivot shaft 90. Said resistance disc 94 provides an offset attaching and torque multiplying means thereto the main cable 96 via attachment of said main cable 96 thereto an edge portion using a common threaded fastener 310. The resistance disc 94 also comprises a cable slot 98 located along an entire curved outer perimeter edge portion which provides a means to nest and accumulate a length of main cable 96 during motioning of the bolster 60 and corresponding rotation of said resistance disc 94.

The main cable 96 comprises a length of common stainless steel wire rope or equivalent flexible conduit which extends downwardly therefrom said resistance disc 94 and is subsequently routed therethrough a main cable pulley portion 182 of a main pulley assembly 180. Said main pulley assembly 180 is mounted securely thereto an enclosure frame member portion 26*a* located along a bottom portion of the enclosure 15 via a "U"-shaped main cable pulley bracket 184 and common threaded fasteners 310. The main cable 96 is subsequently routed upwardly being affixed thereto a bottom surface portion of the load plate 160. Said load plate 160 provides an applied tensile force thereto the main cable 96 via the tension springs 112, 130 being affixed thereto a top surface of said load plate 160. Although a particular number of tension springs 112, 130 are illustrated here, it is understood that any number of fixed resistance springs 112 and adjustable resistance springs 130 may be utilized so as to provide a desired return force thereto the bolster 60 and as such should not be interpreted as a limiting factor of the apparatus 10.

The main cable 96 and tension springs 112, 130 are affixed thereto said load plate 160 using a respective main cable eyelet 162 and a corresponding number of spring eyelets 163. The force applied thereto the main cable 96 by the tension springs 112, 130 provides selective resistance thereto a motioning of the bolster 60 as well as providing a means to return said bolster 60 thereto a top park position (see FIGS. 7*a* and 7*b*).

The springs 112, 130 are supported and suspended therefrom a top portion of the frame 24 via a spring support assembly 140. Said spring support assembly 140 further comprises a spring support bracket 141, a pair of fixed spring shafts 143, and an adjustable spring shaft 144. Said springs 112, 130 comprise heavy-duty tension springs approximately two (2) feet long. Each fixed resistance spring 112 is to be statically anchored thereto a fixed spring shaft 143 via a looping end coil portion thereof in a conventional manner. The adjustable spring shaft 144 provides dynamic attachment of the three (3) adjustable resistance springs 130 via rotating spring pulleys 142 arranged in a linear fashion therealong said adjustable spring shaft 144. Each adjustable resistance spring 130 is supported thereby a respective superjacent spring pulley 142 via a length of adjustable spring cable 145 which is routed therethrough said spring pulley 142 and extended downwardly and affixed thereto a respective brake slide 132. The brake slides 132 provide a means to enable activation of a spring and resultant spring load, to be applied thereto the load plate 160 by mechanically linking a desired number of adjustable resistance springs 130 thereto the load plate 160. A brake locking assembly 136 provides a pinning means to vertically anchor the brake slide 132 thereby causing extension of the attached adjustable resistance spring 130 as the bolster 60 is pivoted, thereby applying said spring load thereto the load plate 160. Conversely, releasing the brake locking assembly 136 prior to bolster 60 manipulation negates a spring load by allowing the brake slide 132 to move freely upward. The brake slide 132 is subsequently returned thereto the lower "home" position via a low-force return spring 135. The return spring 135 is attached thereto a bottom end portion of each brake slide 132 and extends downwardly thereto a subjacent enclosure frame member 26*a*, being attached using common threaded fasteners 310 (see FIGS. 5*a* and 5*b*).

Figure 4B:
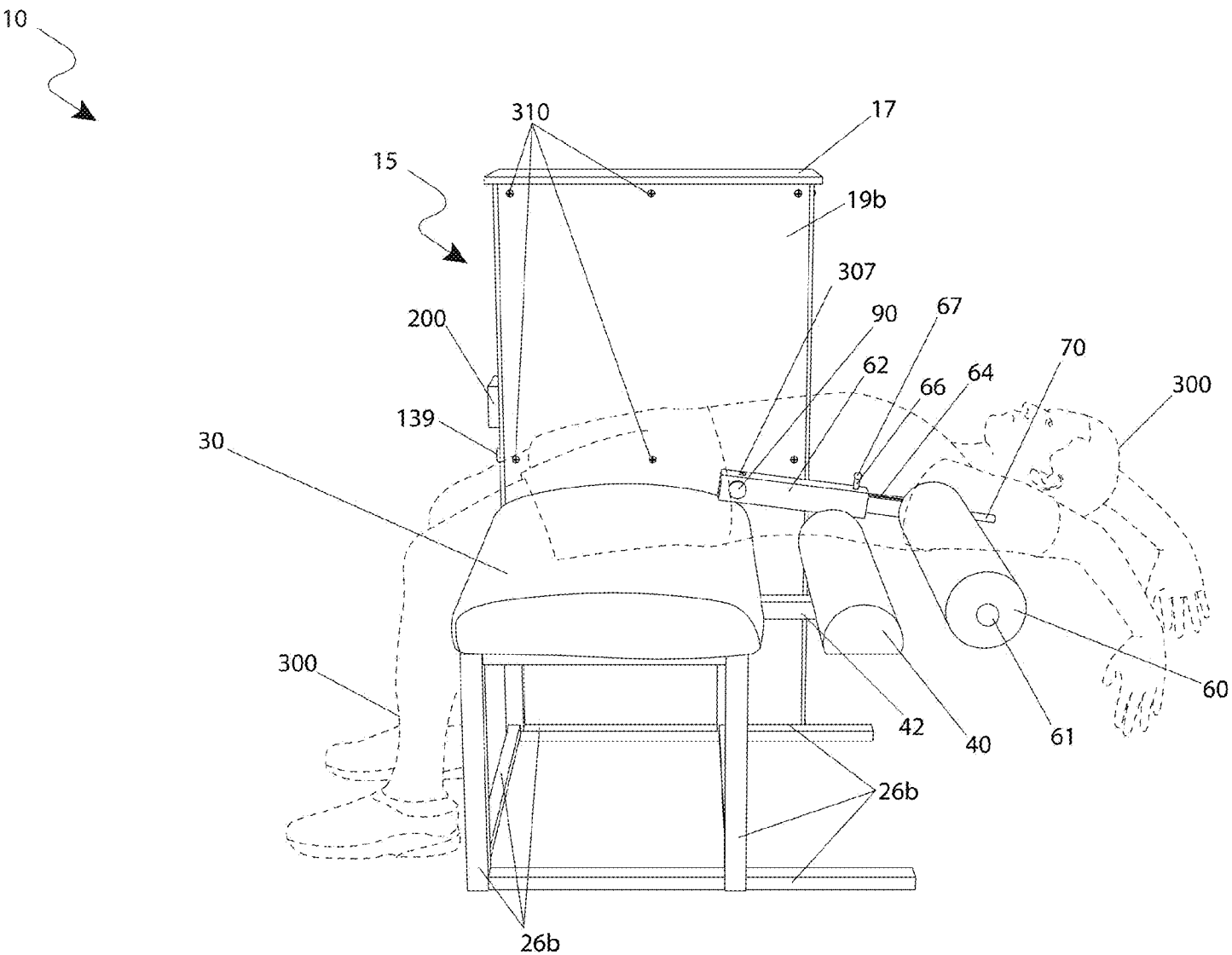
FIG. 4*b* is a perspective view of a bolster 60 depicting a rotated position thereof, according to a preferred embodiment of the present invention.
Figure 4C:
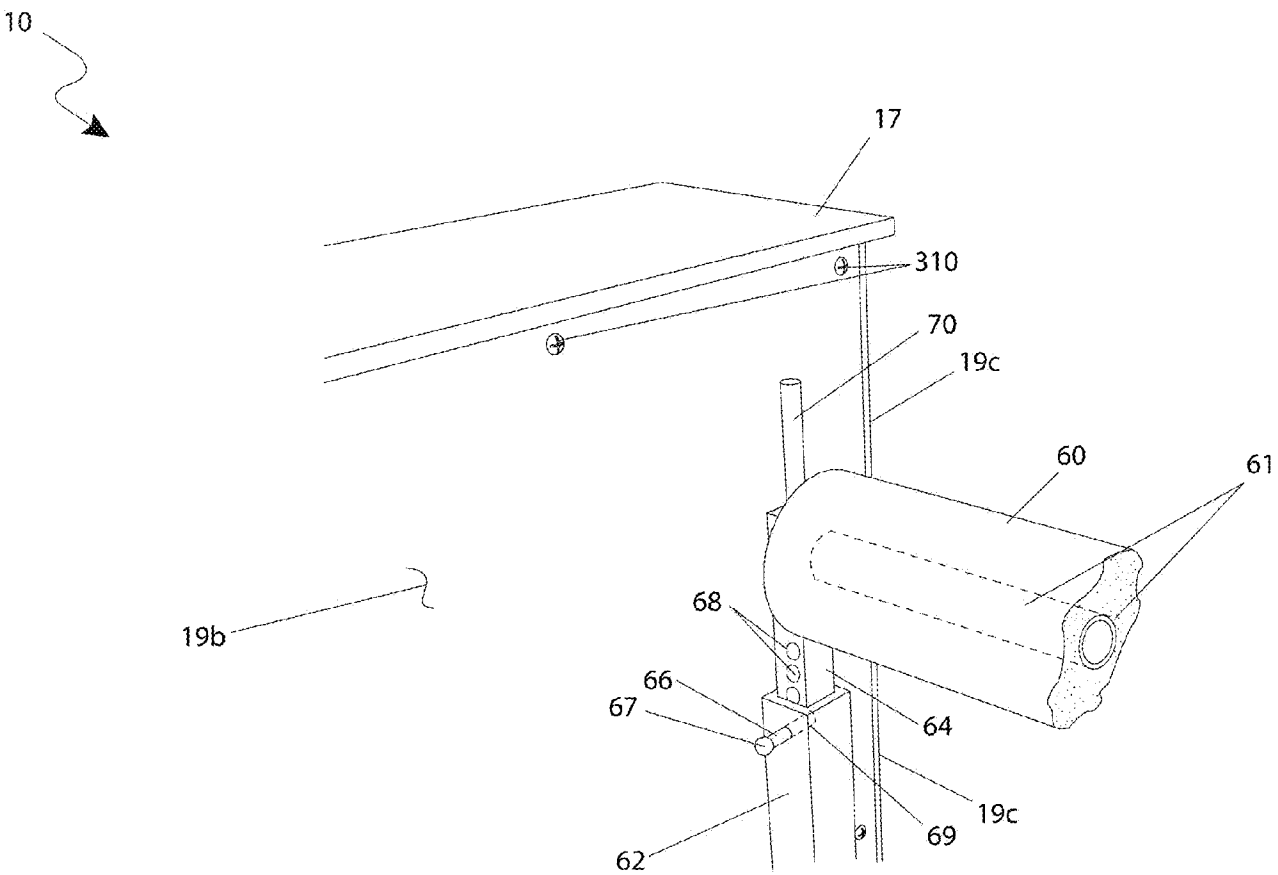
FIG. 4*c* is a close-up perspective view of a bolster locking mechanism 66, according to a preferred embodiment of the present invention.

Referring now to FIGS. 4*a*, 4*b*, and 4*c*, perspective views of the bolster 60 and bolster locking mechanism 66, according to a preferred embodiment of the present invention, are disclosed. The previously described pivot shaft 90 penetrates and protrudes outwardly therethrough the second side exterior panel 19*b*, being adjacent thereto the seat cushion 30. Said pivot shaft 90 is affixed thereto a bolster arm outer post 62 being affixed preferably using a setscrew 307 or other rotary clamping means.

The bolster arm outer post 62 and bolster arm inner post 64 work in conjunction therewith each other to provide a telescoping assembly. Said bolster arm outer 62 and inner 64 posts comprise locking rectangular members being slidingly inserted thereinto each other, thereby providing a means to adjust a height of the bolster portion 60 to conform thereto users 300 having different height torsos. The bolster arm inner post 64 provides welded attachment thereto a bolster rod portion 61 which extends horizontally above the seat cushion 30 at a right angle therefrom said bolster arm inner post 64. The bolster rod 61 provides an internal attaching and supporting means thereto the padded bolster 60 along a central axis thereof. The bolster 60 comprises a padded cylinder made using similar materials as the seat cushion 30 and allows a user 300 to comfortably press thereagainst said bolster 60 with back or side portions of their body. The bolster 60 may be vertically positioned thereat a desired starting height, thereby providing height selectable contact therewith a user's torso 300 in a similar manner as common abdominal exercise machines.

The bolster arm outer post 62 further comprises a bolster locking mechanism 66, an actuating bolster locking mechanism knob 67, and an internal spring-loaded locking pin 69. The bolster locking mechanism 66 establishes a corresponding relative position therebetween said bolster arm outer 62 and inner 64 posts. Adjustment of the bolster 60 height is accomplished by retracting the locking pin 69 using the bolster locking mechanism knob 67; vertically adjusting the bolster arm inner post 64; and, securing said bolster arm inner post 64 by releasing the bolster locking mechanism knob 67, thereby inserting the locking pin 69 thereinto one (1) of a plurality of equally-spaced bolster locking mechanism apertures 68 arranged in a linear manner along a side surface of the bolster arm inner post 64.

The bolster 60 extends laterally intended for use across a user's 300 chest or back area, thereby providing a pivoting motion by rotating about the aforementioned pivot shaft 90. The bolster 60 is to be capable of pivoting therefrom a vertical parked position as seen in FIG. 4*a*, thereto an orientation below a horizontal plane as seen in FIG. 4*b*, thereby enabling a full range of motion thereto back and side portions of a user's 300 torso. As previously described, a torque is applied thereto the pivot shaft portion 90 via mechanisms therewithin the enclosure 15 (see FIG. 2). The pivot shaft 90 in turn translates the resistant torque thereto the bolster 60, thereby restoring the patient or user 300 thereto a seated upright position while performing, for example, forward or rearward extending movements. The resistant torque applied thereto the bolster 60 may also be utilized to aid a user 300 during exercising and strengthening of targeted muscles and/or skeletal groups in need of such therapy.

Additionally, the bolster arm inner post 64 comprises a plastic or rubber cylindrical hand grip 70 which extends therefrom an upper end portion thereof, allowing an assisting person or therapist to aid in said bolster 60 return motion, thereby helping a user 300 to obtain an upright seated position.

Figure 5B:
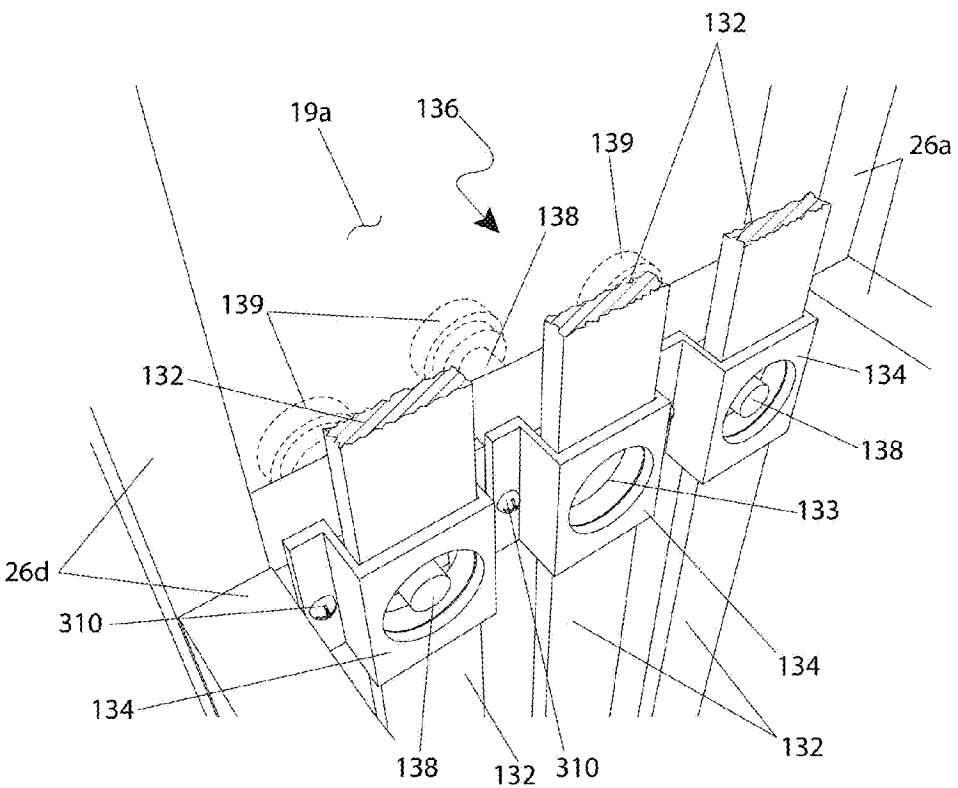
FIG. 5*b* is an interior close-up view of a brake locking assembly portion 136 of the rehabilitation apparatus 10, according to a preferred embodiment of the present invention.
Figure 5A:
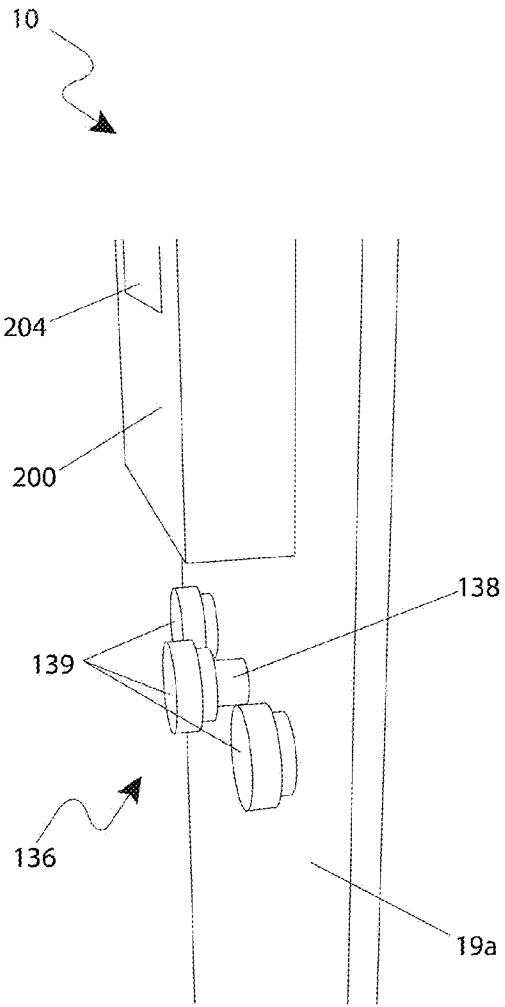
FIG. 5*a* is an exterior close-up view of a brake locking assembly portion 136 of the rehabilitation apparatus 10, according to a preferred embodiment of the present invention.

Referring now to FIGS. 5*a* and 5*b*, exterior and interior close-up views of a brake locking assembly portion 136 of the apparatus 10, according to a preferred embodiment of the present invention, are disclosed. The apparatus 10 comprises three (3) brake slides 132, three (3) brake slide brackets 134, and three (3) brake locking assemblies 136. Each brake slide mechanism 132 provides a means to actuate extension of a corresponding adjustable resistance spring 130, thereby resulting in a selectable variable force being applied thereto the load plate 160 and subsequently thereto pivot shaft 90 and bolster 60 portions. Each brake slide 132 comprises a vertical linear member made of TEFLON® or equivalent high lubricity material. The brake slides 132 are approximately two (2) inches wide and have a rectangular cross-sectional area and are arranged in a parallel manner along an internal surface of a side exterior panel portion 19 of the enclosure 15. Each brake slide 132 is inserted therethrough a stationarily mounted brake slide bracket 134 which guides said brake slide 132 vertically. An anchoring of said brake slide 132 and attached adjustable spring 130 is accomplished via an externally accessed brake locking assembly 136 mounted thereto an exterior surface of the first side exterior panel 19*a*. Each brake locking assembly 136 further comprises a brake toggle pin 138 and a brake toggle knob 139. The brake locking assembly 136 provides a pinning means to vertically anchor the brake slide 132 via manual insertion of the brake toggle pin 138 therethrough a brake slide aperture portion 133 located thereat an intermediate position thereupon said brake slide 132. Likewise, manual retraction of the brake toggle pin 138 therefrom the brake slide aperture portion 133 allows the brake slide 132 and corresponding adjustable resistance spring 130 to move freely in a vertical direction, thereby applying little or no transmitted force thereto the load plate 160.

Referring now to FIG. 6, an upward looking view of a support pad arm portion 42 of the apparatus 10, according to a preferred embodiment of the present invention, is disclosed. The apparatus 10 comprises a support pad arm 42 and a pair of support pad arm brackets 44. The seat cushion 30 provides an attachment means thereto the support pad arm 42 and corresponding brackets 44, being mounted thereto a bottom surface using a plurality of common threaded fasteners 310. The support pad arm 42 is located thereat a subjacent position thereto the previously described bolster 60. The support pad arm 42 provides a means to adjust and secure a desired position of the support pad 40 with regards to the seat cushion 30. Furthermore, the support pad arm 42 may be completely detached therefrom the apparatus 10 if desired based upon particular exercise or therapy requirements. The support pad arm 42 comprises a length of rectangular non-rotating tubing, which extends therefrom the seat cushion 30 being guided in a linear manner via the support pad arm brackets 44. The support pad arm brackets 44 comprise rugged "U"-shaped metal fixtures having outwardly extending fastening appendages and inner height and width dimensions so as to slidingly receive said support pad arm 42 therethrough. Each support pad arm bracket 44 further comprises a support arm adjustment knob 46 being threadingly attached thereto along a bottom surface. Said support arm adjustment knobs 46 comprise common knob and stud devices which enable manual clamping of the inserted support pad arm 42 therewithin the bracket 44.

Figure 7A:
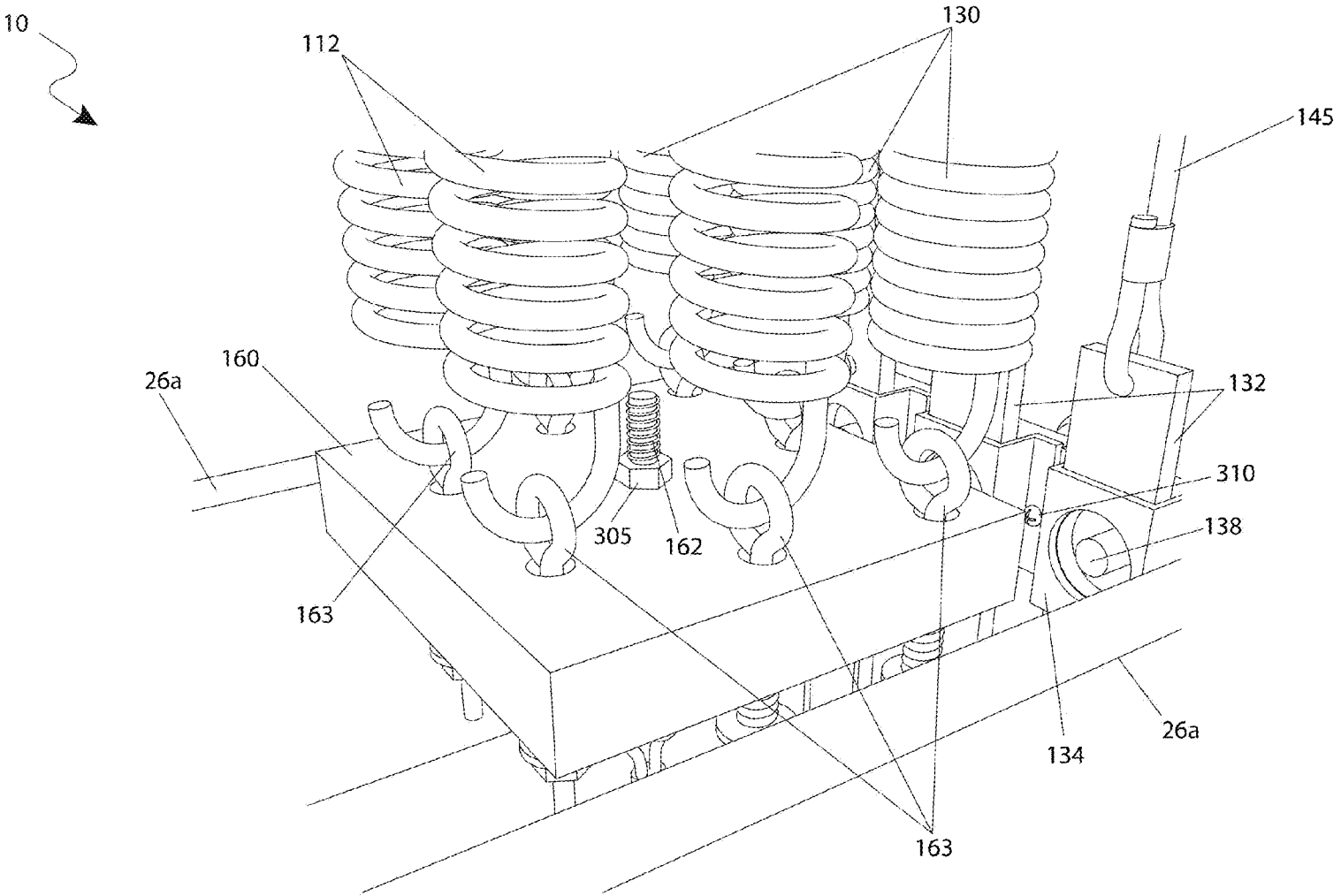
FIG. 7*a* is a top view of a load plate portion 160 of the rehabilitation apparatus 10, according to a preferred embodiment of the present invention; and, FIG. 7*b* is a bottom view of a load plate portion 160 of the rehabilitation apparatus 10, according to a preferred embodiment of the present invention.
Figure 7B:
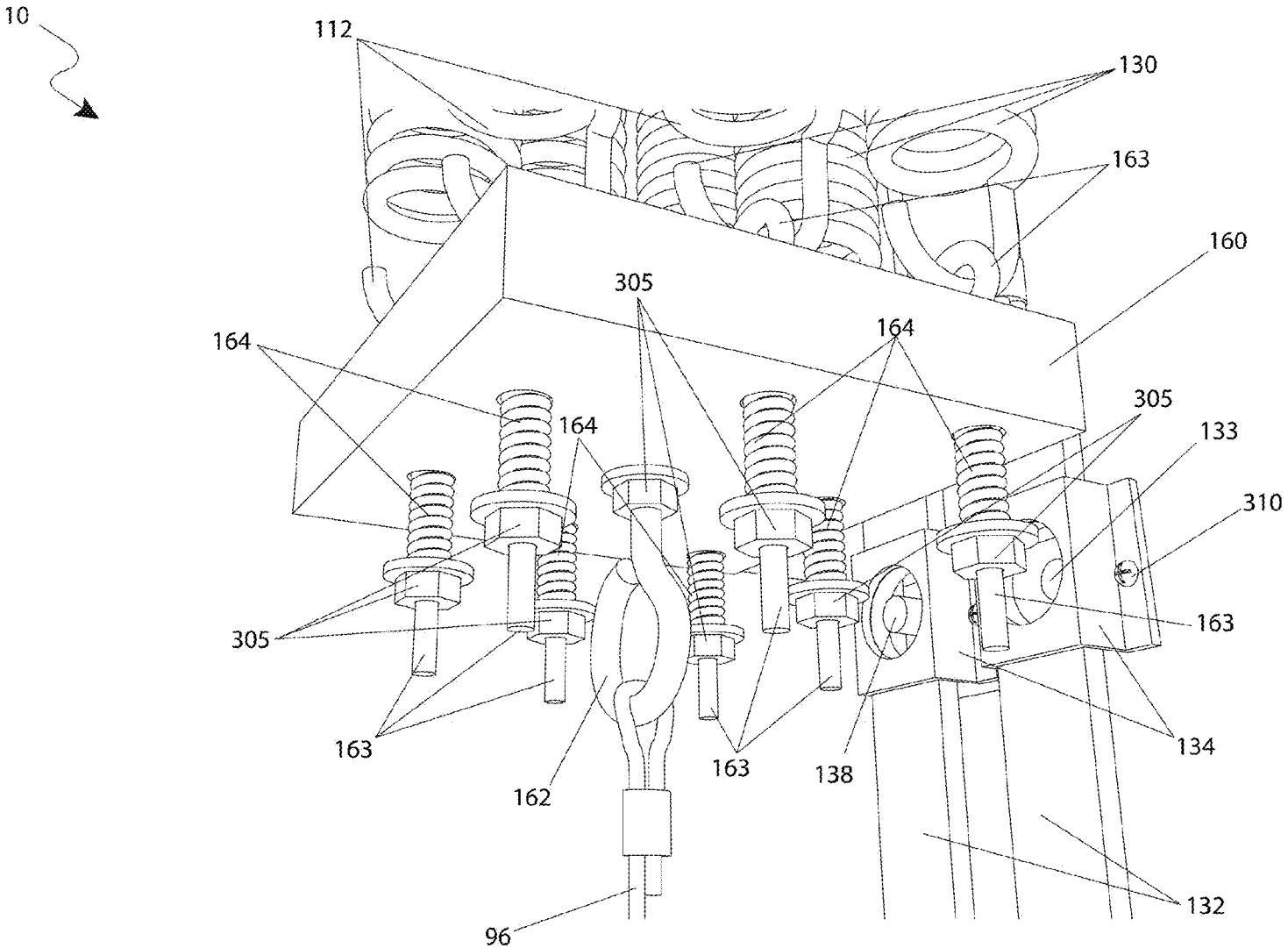

Referring now to FIGS. 7*a* and 7*b*, top and bottom views of a load plate portion 160 of the apparatus 10, according to a preferred embodiment of the present invention, are disclosed. The load plate 160 comprises a horizontal metal or plastic plate approximately one (1) inch thick providing rugged attachment of the main cable 96 therealong a bottom surface and the tension springs 112, 130 along a top surface thereof. Said main cable 96 and springs 112, 130 are affixed thereto said load plate 160 via a main cable eyelet 162 and spring eyelets 163, respectively, being secured using common nut fasteners 305. Additionally, each spring eyelet 163 is inserted therethrough a cushioning spring 164 located beneath the load plate 160 and captivated using the nut fastener 305. The cushioning springs 164 provide a smooth "ramp-up" of a resisting spring forces as they are applied thereto the load plate 160 during initial motioning of the bolster 60 by a user 300.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user 300 in a simple and effortless manner with little or no training. After initial purchase or acquisition of the apparatus 10, it would be configured and utilized as indicated in FIGS. 1, 4*a*, 4*b*, 4*c*, 5*a*, and 6.

The method of utilizing the apparatus 10 may be achieved by performing the following steps: placing the apparatus 10 upon a flat stable surface such as a floor surface; adjusting a position of the support pad 40 so as to correspond thereto a lower back or pelvic area by loosening the support arm adjustment knobs 46; extending the support pad arm 42 inwardly or outwardly thereto a desired position; tightening said support arm adjustment knobs 46 to secure the support pad 40 in position; adjusting the bolster 60 thereto a desired height by pulling the bolster locking mechanism knob 67 outwardly; raising or lowering the bolster 60 as desired; retaining said bolster 60 thereat a desired height by releasing the bolster locking mechanism knob 67, thereby engaging the locking pin 69 therewith a bolster locking mechanism aperture 68; increasing the resistance force being applied thereto the bolster 60 to return a patient or user 300 to a seated position by manually pressing one (1) or more brake toggle knobs 139 inwardly, thereby engaging a brake toggle pin 138 therewith a brake slide aperture portion 133 of a corresponding brake slide 132; connecting and initiating electronic and/or software functions such as personal therapy regimen data, personal therapy logging, data uploading/downloading therefrom a portable computer 206, audio/music playing, heart rate/cadence monitoring, and the like, using the data module 200; performing any number of therapeutic exercises and/or movements as desired or as prescribed by a physician or therapist; utilizing the grip 70 by an assisting individual to help a patient 300 to return to a sitting position during execution of said therapeutic movements; and, benefiting therefrom improved muscular and skeletal physical therapy afforded a user 300 of the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A rehabilitation apparatus for enhancing flexibility by controlling stretching of back muscles, said rehabilitation apparatus comprising:

an enclosure;

a seat cushion attached to said enclosure;

a bolster movable along a resistive arc defined between a vertical position and a position below a horizontal plane respectively;

a pivot shaft connected to said bolster and rotatably connected to said enclosure;

a resistance disc mated to said pivot shaft;

a main cable connected to said resistance disc;

a load plate;

a main pulley assembly guiding said main cable upwardly to said load plate;

a plurality of tension springs connected to said load plate for providing an adjustable return force to return said bolster to said vertical position, further comprising:

a plurality of fixed resistance springs anchored to said load plate and said enclosure respectively; and, a plurality of adjustable resistance springs anchored to said load plate and said enclosure respectively;

a spring support assembly attached to said plurality of tension springs for providing a resistive force against rotation of said bolster; and, a plurality of brake locking assemblies attached to said spring support assembly and said tension springs respectively;

wherein said spring support assembly further comprises:

a plurality of spring support brackets connected to said enclosure;

a pair of fixed spring shafts connected to said spring support brackets and said fixed resistance springs respectively;

a spring shaft anchored to said spring support brackets and said adjustable resistance springs respectively;

a plurality of pulleys anchored to said enclosure and situated above said adjustable resistance springs respectively;

a plurality of return springs anchored to said enclosure and said brake locking assemblies; and, a plurality of adjustable resistance cables anchored to said adjustable resistance springs and routed along said pulleys and anchored to said brake locking assemblies respectively; and, wherein said brake locking assemblies actuate extension of selected ones of said tension springs thereby resulting in a selectable variable force applied to said load plate and subsequently to said pivot shaft and said bolster respectively.

2. The rehabilitation apparatus of claim 1, wherein said bolster comprises:

a bolster arm outer post; and, a bolster arm inner post telescopically attached to said bolster arm outer post such that said bolster is vertical adjustable to a desired height above said seat cushion.

3. The rehabilitation apparatus of claim 1, further comprising:

a data module attached to said enclosure for monitoring personal therapy regimen data.

4. The rehabilitation apparatus of claim 1, further comprising:

a plurality of anchoring shaft brackets affixed to said enclosure for rotatably receiving said pivot shaft therethrough.

5. The rehabilitation apparatus of claim 1, wherein said resistance disc comprises:

a cable slot located along an entire curved outer perimeter edge portion in which said main cable is nested during rotation of said bolster and said resistance disc.

6. The rehabilitation apparatus of claim 1, wherein each of said plurality of brake locking assemblies comprises:

a plurality of brake slides each comprising a vertical linear member arranged in a parallel manner within said enclosure;

a plurality of brake slide brackets stationarily mounted to said enclosure, said brake slides being inserted through said brake slide brackets respectively; and, a plurality of brake toggle pins and brake toggle knobs providing resistive force against said brake slides.

7. A rehabilitation apparatus for enhancing flexibility by controlling stretching of back muscles, said rehabilitation apparatus comprising:

an enclosure;

a seat cushion attached to said enclosure;

a bolster movable along a resistive arc defined between a vertical position and a position below a horizontal plane respectively;

a pivot shaft rigidly connected to said bolster and rotatably connected to said enclosure;

a resistance disc seated inside said enclosure and rigidly mated to said pivot shaft;

a main cable connected to said resistance disc;

a load plate;

a main pulley assembly seated within said enclosure and thereby guiding said main cable upwardly to said load plate;

a plurality of tension springs housed within said enclosure and connected to said load plate for providing an adjustable return force to return said bolster to said vertical position, further comprising:

a plurality of fixed resistance springs anchored to said load plate and said enclosure respectively; and, a plurality of adjustable resistance springs anchored to said load plate and said enclosure respectively;

a spring support assembly attached to said plurality of tension springs for providing a resistive force against rotation of said bolster; and, a plurality of brake locking assemblies attached to said spring support assembly and said tension springs respectively;

wherein said spring support assembly further comprises:

a plurality of spring support brackets connected to said enclosure;

a pair of fixed spring shafts connected to said spring support brackets and said fixed resistance springs respectively;

a spring shaft anchored to said spring support brackets and said adjustable resistance springs respectively;

a plurality of pulleys anchored to said enclosure and situated above said adjustable resistance springs respectively;

a plurality of return springs anchored to said enclosure and said brake locking assemblies; and, a plurality of adjustable resistance cables anchored to said adjustable resistance springs and routed along said pulleys and anchored to said brake locking assemblies respectively; and, wherein said brake locking assemblies actuate extension of selected ones of said tension springs thereby resulting in a selectable variable force applied to said load plate and subsequently to said pivot shaft and said bolster respectively.

8. The rehabilitation apparatus of claim 7, wherein said bolster comprises:

a bolster arm outer post; and, a bolster arm inner post telescopically attached to said bolster arm outer post such that said bolster is vertical adjustable to a desired height above said seat cushion.

9. The rehabilitation apparatus of claim 7, further comprising:

a data module attached to said enclosure for monitoring personal therapy regimen data.

10. The rehabilitation apparatus of claim 7, further comprising:

a plurality of anchoring shaft brackets affixed to said enclosure for rotatably receiving said pivot shaft therethrough.

11. The rehabilitation apparatus of claim 7, wherein said resistance disc comprises:

a cable slot located along an entire curved outer perimeter edge portion in which said main cable is nested during rotation of said bolster and said resistance disc.

12. The rehabilitation apparatus of claim 7, wherein each of said plurality of brake locking assemblies comprises:

a plurality of brake slides each comprising a vertical linear member arranged in a parallel manner within said enclosure;

a plurality of brake slide brackets stationarily mounted to said enclosure, said brake slides being inserted through said brake slide brackets respectively; and, a plurality of brake toggle pins and brake toggle knobs providing resistive force against said brake slides.

13. A method of utilizing a rehabilitation apparatus for enhancing flexibility by controlling stretching of back muscles, said method comprising the steps of:

providing an enclosure;

providing and attaching a seat cushion to said enclosure;

providing a bolster movable along a resistive arc defined between a vertical position and a position below a horizontal plane respectively;

providing and rigidly connecting a pivot shaft to said bolster;

rotatably connecting said pivot shaft to said enclosure;

providing and seating a resistance disc inside said enclosure by rigidly mating said resistance disc to said pivot shaft;

providing and connecting a main cable to said resistance disc;

providing a load plate;

providing and seating a main pulley assembly within said enclosure;

said main pulley guiding said main cable upwardly to said load plate;

providing an adjustable return force to return said bolster to said vertical position by providing and housing a plurality of tension springs within said enclosure;

connecting a plurality of fixed resistance springs of said tension springs to said load plate and connecting a plurality of adjustable resistance springs of said tension springs to said load plate;

providing a resistive force against rotation of said bolster by providing and attaching a plurality of spring support brackets via a pair of fixed spring shafts of a spring support assembly to said fixed resistance springs of said tension springs, and providing and attaching a spring shaft of said spring support assembly to said adjustable resistance springs of said tension springs;

attaching said plurality of spring support brackets of said spring support assembly to said enclosure;

attaching a plurality of pulleys of said spring support assembly to said enclosure situated above said adjustable resistance springs;

providing and attaching a plurality of brake locking assemblies to a plurality of return springs of said spring support assembly and to a plurality of adjustable resistance cables, routed along said pulleys, of said adjustable resistance springs of said tension springs respectively; and, applying a selectable variable force to said load plate and subsequently to said pivot shaft and said bolster respectively when said brake locking assemblies actuate extension of selected ones of said tension springs.

* * * * *